United States Patent [19]

Kobelt

[11] Patent Number: 4,522,111

[45] Date of Patent: Jun. 11, 1985

[54] DOUBLE-ACTING, FLUID ACTUATED POSITIONING ACTUATOR

[76] Inventor: Jacob Kobelt, 6110 Oak St., Vancouver, British Columbia, Canada, V6M 2W2

[21] Appl. No.: 417,462

[22] Filed: Sep. 13, 1982

[51] Int. Cl.[3] ..... F01B 19/00

[52] U.S. Cl. ..... 92/48; 92/64; 92/94; 92/98 D; 92/131

[58] Field of Search ..... 92/48, 50, 38, 131, 92/94, 97, 99, 98 D, 63, 64, 69, 75

[56] References Cited

U.S. PATENT DOCUMENTS

| | | | |
|---|---|---|---|
| 2,308,875 | 1/1943 | Goepfrich | 92/75 |
| 2,671,470 | 3/1954 | Boteler | 92/48 |
| 2,724,407 | 11/1955 | Robinson | 92/75 |
| 3,838,630 | 10/1974 | Kobelt | 92/48 |

*Primary Examiner*—Sheldon J. Richter
*Assistant Examiner*—Randolph A. Smith
*Attorney, Agent, or Firm*—Carver & Co.

[57] ABSTRACT

An infinitely variable, double-acting positioning linear actuator which responds proportionally to fluid pressure includes a hollow cylindrical housing and an actuating rod axially movable through the housing. Two partitions cooperate with the actuating rod for movement therewith and define within the housing a spring chamber and first and second actuating chambers which are at opposite ends of the spring chamber. A compression spring is mounted within the spring chamber and each actuating chamber has a fluid port to communicate with pressurized fluid. First and second retaining structures within the spring chamber cooperate with respective ends of the spring and each have a respective stop. The spring chamber has a limiting structure which cooperates with the stops to hold the stops spaced apart at a particular spacing when the actuator is centered. The limiting structure also permits limited axial movement of one of the stops relative to the housing and the remaining stop during actuating rod stroke, which stroke is no greater than the particular spacing between the stops. The actuator is relatively compact and simple, uses one spring, and preferably the partitions are rolling diaphragms extending between the actuating rod and the housing.

12 Claims, 2 Drawing Figures

DOUBLE-ACTING, FLUID ACTUATED POSITIONING ACTUATOR

BACKGROUND OF THE INVENTION

1. Field of the Invention

The invention relates to a fluid operated linear actuator which provides infinitely variable linear positioning in two axial directions, particularly adapted for, but not limited to, use with servo mechanisms for controlling propeller pitch or power steering systems for marine vessels.

2. Prior Art

Double-acting positioning actuators have been known for a long time and commonly utilize an axially movable actuating rod slidably mounted within an elongated cylinder. Some of the actuators have one piston secured to the actuating rod, with two compression coil springs sandwiching the piston to center it within the cylinder. Later actuators utilized one compression coil spring mounted between two pistons, the pistons being rolling diaphragms having inner portions secured to the rod and outer portions secured to spaced positions on the cylinder wall. One example of the later type of actuator is shown in the present applicant's U.S. Pat. No. 3,838,630 issued 1 Oct. 1974 and entitled Double-Acting Positioning Linear Actuator. Although this actuator functions well in many applications, it has a relatively long overall length for the length of its stroke, thus limiting use of the actuator to applications where excessive overall length is not a major consideration. Furthermore, some of the earlier actuators, while being mechanically relatively simple, require manufacture and assembly of a multiplicity of parts, some of which were relatively costly to produce, and thus result in relatively high production and maintenance costs.

SUMMARY OF THE INVENTION

The present invention reduces some of the difficulties and disadvantages of the prior art by providing a double-acting positioning actuator which has a relatively short overall length compared with the stroke of the actuator. This permits the actuator to be used in applications where overall length is restricted. Furthermore, the present invention is relatively simple, and uses parts which are relatively easy to produce, particularly by modern mass production methods.

A double-acting positioning actuator according to the invention has a hollow cylindrical housing, and an actuating rod passing through the housing and being mounted for axial movement relative to the housing along a cylinder axis. The actuator has first and second partition means cooperating with the actuating rod for axial movement therewith, and for defining and separating a spring chamber and first and second actuating chambers which are spaced apart at opposite ends of the spring chamber within the housing. The rod and partition means are sealed relative to the chambers, and a compression spring means having first and second ends is fitted within the spring chamber. A fluid port in each actuation chamber communicates with a pressurized fluid supply. The actuator is further characterized by first and second retaining means and a limiting means. The first and second retaining means are fitted within the spring chamber and cooperate with the first and second ends of the spring means respectively, each retaining means having a respective stop means. The spring chamber has the limiting means having opposed shoulders adapted to cooperate with the stop means to hold the stop means of the retaining means spaced apart at a particular spacing when the actuator rod is centered. The limiting means also provides a clearance extending axially between the opposed shoulders to receive the stop means therein so as to permit limited axial movement of one of the stop means relative to the housing and the remaining stop means during a stroke of the actuating rod, the stroke being no greater than the particular spacing between the stop means when the actuator is centered.

A detailed disclosure following, related to drawings, describes a preferred embodiment of the invention which is capable of expression in structure other than that described and illustrated.

DETAILED DISCLOSURE

Figure 1:
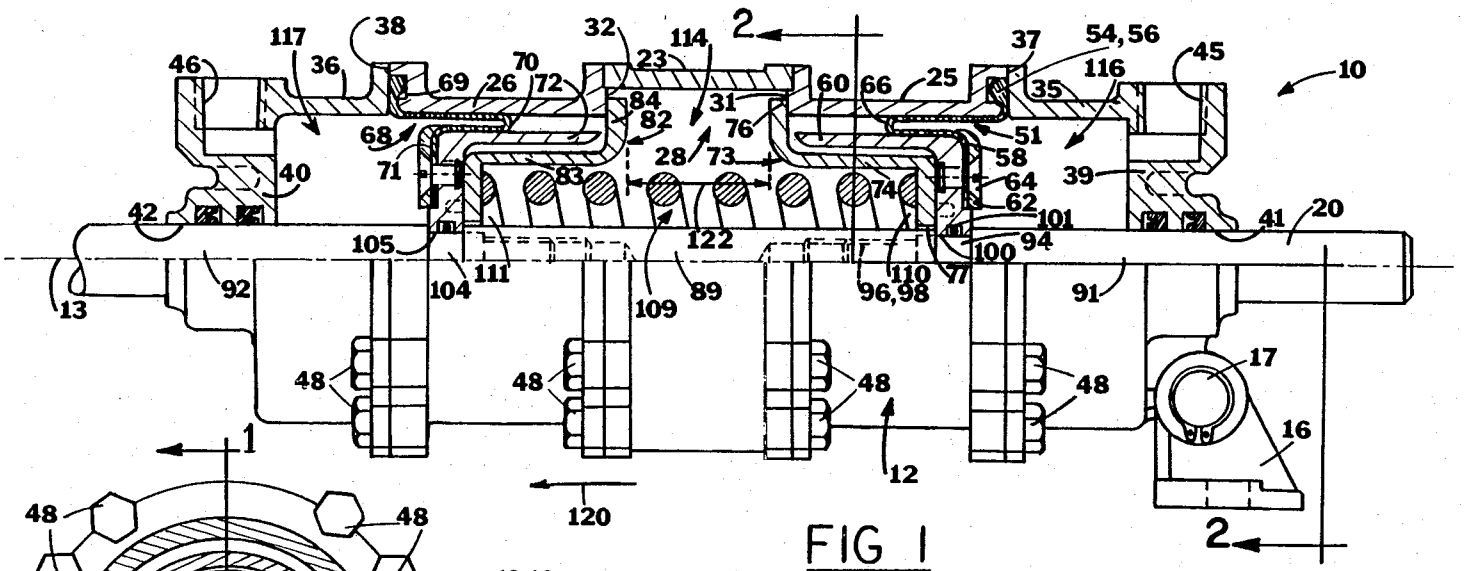
FIG. 1 is a simplified, fragmented, part-longitudinal section, part-side elevation of a double-acting positioning actuator according to the invention, as would be seen from line 1—1 of FIG. 2.
Figure 2:
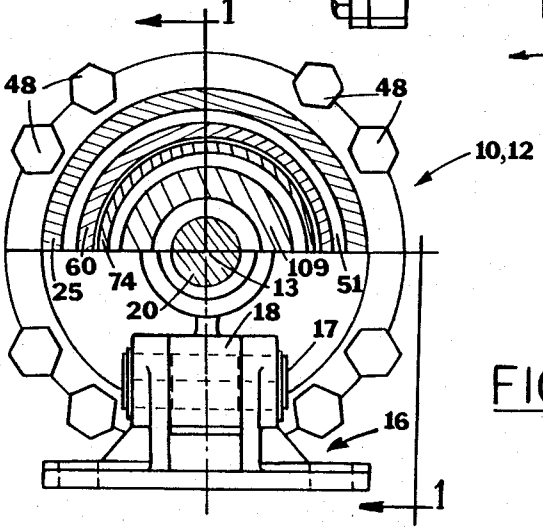
FIG. 2 is a simplified transverse section of the invention as seen from line 2—2 of FIG. 1.

FIGS. 1 and 2

A double-acting positioning actuator 10 according to the invention has a hollow cylindrical housing 12 having a longitudinal cylinder axis 13. The housing is mounted on a trunnion mounting bracket 16 having a mounting pin 17 passing through a journal 18 integral with the housing, to permit swinging of the housing about the trunnion bracket. The actuator has an actuating rod 20 passing through the housing and being mounted for axial movement relative to the housing along the cylinder axis 13.

The cylindrical housing has an inner annular member 23 and first and second intermediate annular members 25 and 26 respectively. The two members 25 and 26 have respective bore diameters and are secured in spaced aligned relationship, one on either side of the inner annular member 23, so as to sandwich the inner annular member therebetween. The bore of the inner annular member is greater than the bores of the intermediate annular members to provide an annular recess 28 adjacent the center of the housing, the recess being defined by opposed annular end walls 31 and 32 respectively. The cylindrical housing also has two outer cup members 35 and 36 secured in spaced aligned relationship to two outer faces 37 and 38 of the intermediate annular members 25 and 26 respectively, so as to sandwich the inner member and the two intermediate members therebetween. The cup members 35 and 36 have end walls 39 and 40 respectively having aligned sealed bores 41 and 42 respectively to receive the actuating rod as a sliding fit therein. The cup members 35 and 36 also have fluid ports 45 and 46 respectively to communicate with fluid conduits, not shown, which communicate with a pressurized fluid supply and directional valve means, not shown, as required. The members 23, 25, 26, 35 and 36 and secured together at adjacent edge portions, as shown, by a plurality of bolts 48 in respective flanges.

A first rolling diaphragm 51 has an outer portion 54 secured to an interconnection between the adjacent intermediate annular member 25 and outer cup member 35. The outer face 37 of the member 25 has an annular recess to receive an enlarged lip 56 of the portion 54 of the diaphragm which acts as an integral O-ring seal so that the interconnection between the members 25 and 35 is sealed to prevent leakage therebetween. The diaphragm 51 has an inner portion 58 cooperating with the actuating rod for axial movement therewith by sandwiching between a diaphragm holder 60 and a retaining ring 62 secured to the holder by screws 64, one screw only being shown. The diaphragm holder 60 is cup-shaped and, as will be described, is mounted on the rod 20 to permit relative rotation between the rod and holder, but to prevent any material relative axial movement between the rod and holder. Thus, while the actuator is being installed, the installer can rotate the rod 20 relative to the housing 12 without unduly straining the diaphragm due to the rotation. The diaphragm has an annular fold 66 disposed between the inner and outer portions to permit relative axial movement between the rod and the housing with negligible diaphragm strain. A second rolling diaphragm 68 is essentially similar to the first diaphragm and has an outer portion 69 secured to the housing, an annular fold 70, and an inner portion 71 secured to a second diaphragm holder 72 mounted on the actuating rod, the structure being identical to that on the opposite side of the housing.

A first retaining means 73 has a cup portion 74 and an outwardly extending rim portion 76 which defines a top hat shape. The cup portion has a central bore 77 through which the actuating rod 20 passes easily so that the retaining means is a sliding fit on the actuating rod. As best seen in FIG. 2, the cup portion 74, the diaphragm holder 60 and the intermediate annular member 25 are three annuli concentric with the axis 13 and spaced apart with sufficient clearance therebetween to permit easy relative axial movement. Note that sufficient clearance is required between the diaphragm holder 60 and the member 25 to permit easy rolling and folding of the diaphragm 51 therebetween. The outer rim 76 extends sufficiently from the cup portion, and outwardly beyond the diaphragm holder and the member 25 to enter the recess 28 so as to engage the end wall 31. A similar second retaining means 82 has a cup portion 83 fitted within the diaphragm holder 72, and has an outer rim portion 84 engaging the end wall 32, the cup portion being a sliding fit on the rod 20 also.

The actuating rod 20 has a central rod member 89 and first and second outer rod members 91 and 92 respectively which are interconnected adjacent the diaphragm holders 60 and 72 and have generally equal diameters throughout their lengths, except as follows. The outer rod member 91 has a portion 94 of reduced diameter provided adjacent a smaller diameter externally threaded end portion 96, shown in broken outline. The central rod member 89 has an internally threaded end portion 98, also in broken outline, which is complementary to the end portion 96 for securing the two rod portions in aligned relationship. It can be seen that the portion 94 of reduced diameter has a diameter less than adjacent rod portions and is defined by opposed shoulders which are adjacent ends of the portions 89 and 91. The diaphragm holder 60 has a central bore 100 of a diameter less than the remaining diameter of the rod portions 89 and 91, that is less than diameter of the opposed shoulders, and slightly larger than the portion 94 so as to be rotationally mounted thereon. The holder has a central portion with the central bore which is slightly narrower than the space between the shoulders to permit free rotation thereon with negligible relative axial movement so as to follow axial movement of the rod. The central bore has an internal groove which carries a seal 101 to seal against the portion 94 of reduced diameter. It can be seen that the seal 101 cooperates with the rod and diaphragm holder to seal the portion of reduced diameter and the central bore so as to prevent leakage of air therebetween. Similarly, the second outer rod member 92 has a portion of reduced diameter 104 which is complementary to a similarly sealedbore 105 of the second diaphragm holder 72. This permits easy manufacturing of the actuator rod portions, and easy assembly of the diaphragm holders and other components on the actuator rod, and also reduces diaphragm strain that might otherwise occur during installation due to relative rotation.

A compression coil spring 109 has first and second ends 110 and 111 respectively which are retained in the cup portions 74 and 83 of the first and second retaining means respectively. When the rod is centered as shown in FIG. 1, the coil spring 109 is compressed between opposed cup portions of the first and second retaining means, the outer rims of which are held by adjacent end walls 31 and 32 of the recess 28. The diaphragm holders 60 and 72 are spaced apart and are generally cup shaped and face inwardly so as to be complementary to adjacent retaining means 73 and 82 respectively so that, when the actuator is centered as shown, each diaphragm holder encloses a cup portion of an adjacent retaining means. It can be seen that inner portions of the diaphragm holders extend over the adjacent cup portions a distance greater than maximum length of the fold of the adjacent diaphragm so as to prevent trapping of the diaphragm between the holder and the retaining means.

It can be seen that the inner annular member 23 and the two intermediate annular members 25 and 26 define portions of a spring chamber 114 which encloses the retaining means and the spring means, and has opposite outer ends defined by the diaphragm and associated holders. Also it can be seen that the two outer cup members 35 and 36 define portions of first and second actuating chambers 116 and 117, which chambers are adapted to receive fluid from the respective fluid ports 45 and 46.

OPERATION

With zero or equal air pressures within the actuating chambers 116 and 117, the actuator is centered so that the stop means engage the end walls of the recess 28, that is the rim portions 76 and 84 are engaged with adjacent end walls 31 and 32 of the recess 28. If excess pressure is applied to the first actuating chamber 116, the diaphragm holder 60 shifts in direction of an arrow 120 which causes the rim portion 76 to move away from the end wall 31, simultaneously compressing the spring 109 which increases force between the rim portion 84 and the adjacent end wall 32. As pressure difference between the first and second actuating chambers increases, the spring 109 further compresses and movement of the diaphragm holder in direction of the arrow 120 is limited when the rim portion 76 thereof contacts the rim portion 84 of the cup portion 83. This represents a maximum stroke of the actuating cylinder from the centered position and clearly, additional increases in pressure in the chamber 116 cannot extend the actuating rod any further leftwards. Correspondingly, with a decrease in pressure in the chamber 116, the actuating rod 20 returns rightwards to a centered position as shown. Correspondingly, when the second actuating chamber 117 is at a higher pressure than the first actuating chamber, the reverse occurs and the rod shifts in an opposite direction, ie. rightwards, until the rim portion 84 contacts the rim portion 76. It can be seen that the annular recess 28 having the two opposite end walls 31 and 32 serves as a limiting means within the spring chamber portion of the housing, the limiting means having opposed shoulders, that is the end walls 31 and 32. Furthermore, it can be seen that the rim portions 76 and 84 serve as stop means of the retaining means adapted to extend into the annular recess for axial movement therewithin to limit movement of the actuating rod. Also the limiting means of the spring chamber portion is adapted to cooperate with the stop means of the retaining means to hold the stop means spaced apart at a particular spacing 122 when the actuator is centered. The limiting means provides a clearance extending axially between the opposed shoulders to receive the stop means therein so as to permit limited axial movement of one of the stop means relative to the housing and the remaining stop means during a stroke of the actuating rod. Each retaining means has the outwardly extending rim portion to serve as respective stop means and having inner and outer faces. Thus the outer face of a particular rim portion is adapted to contact an adjacent end wall of the annular recess, and the inner face of the particular rim portion is adapted to contact the inner face of the rim portion of the remaining retaining means to limit the stroke. Thus, it can be seen that the stroke of the actuating rod is limited by interference between opposed faces of the stop means. It is noted that the stroke of the actuator is relatively long with respect to overall length of the actuator when compared with some prior art actuator of similar overall length. Also, the components of this actuator are relatively simple and can be produced by low cost production methods when compared with some prior art actuators, thus reducing manufacturing and maintenance costs.

ALTERNATIVES AND EQUIVALENTS

As stated above, the stroke of the actuating rod is limited by interference between opposed faces of the stop means, but other limiting means can be devised, for example collars mounted on the actuating rod which interfere with the outer faces of the cup members of the housing prior to interference between the opposed end faces of the stop means. Also, as described, the spring chamber is separated from the adjacent actuating chambers by the rolling diaphragms 51 and 68, but alternative partition means to separate adjacent chambers from each other can be substituted for the diaphragms. It can be seen that the diaphragms and associated structure serve as partition means cooperating with the actuating rod for movement therewith, and for defining and separating the spring chamber and the first and second actuating chambers spaced apart at opposite ends of the spring chamber within the housing. The rod and partition means are sealed relative to the chambers, and clearly, if alternative partition means, such as a rigid piston disc fitted with a sliding cup seal to engage a cylinder wall of the housing were substituted, similar sealing would be required. However, the diaphragm is preferred to reduce problems.

I claim:

1. A double-acting positioning actuator having: a hollow cylindrical housing; an actuating rod passing through the housing and being mounted for axial movement relative to the housing along a cylinder axis; first and second partition means cooperating with the actuating rod for axial movement therewith and for defining and separating a spring chamber and first and second actuating chambers spaced apart at opposite ends of the spring chamber within the housing; the rod and partition means being sealed relative to the chambers; a compression spring means having first and second ends and being mounted within the spring chamber; a fluid port in each actuation chamber to communicate with a pressurized fluid supply, the actuator being further characterized by:

(a) first and second retaining means fitted within the spring chamber and cooperating with the first and second ends of the spring means respectively, each retaining means having a respective stop means, (b) the spring chamber having a limiting means having opposed shoulders adapted to cooperate with the stop means of the retaining means to hold the stop means spaced apart at a particular spacing when the actuator is centered, the limiting means providing a clearance extending axially between the opposed shoulders to receive the stop means therein so as to permit limited axial movement of one of the stop means relative to the housing and the remaining stop means during a stroke of the actuating rod, the stroke being no greater than the particular spacing between the stop means when the actuator is centered.

2. An actuator as claimed in claim 1 further characterized by:

(a) the stroke of the actuating rod is limited by interference between opposed faces of the stop means.

3. An actuator as claimed in claim 1 in which:

(a) the clearance provided by the limiting means is an annular recess within the spring chamber, (b) the stop means of the retaining means extend into the annular recess for axial movement therewithin.

4. An actuator as claimed in claim 3 in which:

(a) the annular recess has two oppositely facing end walls which define the opposed shoulders, (b) each retaining means has an outwardly extending rim portion having inner and outer faces, the outer face being adapted to contact an adjacent end wall of the annular recess, and the inner face being adapted to contact the inner face of the rim portion of the remaining retaining means to limit the stroke.

5. An actuator as claimed in claim 4 in which:

(a) each retaining means has a cup portion to receive an end of the compression spring means, and the rim portion to cooperate with the annular recess, so as to define a top hat shape.

6. An actuator as claimed in claim 1 in which:

(a) each partition means is a rolling diaphragm having an outer portion secured to the housing and an inner portion cooperating with the actuating rod, the diaphragm having an annular fold between the inner and outer portions thereof to permit relative axial movement between the rod and the housing with negligible diaphragm strain.

7. An actuator as claimed in claim 6 further including:

(a) each retaining means having a cup portion to receive an end of the compression spring means and an outwardly extending rim portion to cooperate with the limiting means, thus defining the top hat shape, (b) a diaphragm holder for each partition means mounted on the rod to follow axial movement of the rod, each diaphragm holder being generally cup-shaped and facing inwardly so as to be complementary to an adjacent retaining means so that, when the actuator is centered, each diaphragm holder encloses a cup portion of an adjacent retaining means, so as to prevent trapping of the diaphragm between the holder and the retaining means.

8. An actuator as claimed in claim 1 in which:

(a) the actuating rod has a central rod member and two outer rod members which are interconnected adjacent the partition means, portions of at least one of the rod members adjacent the interconnections being of reduced diameter relative to adjacent portions of the rod members, the portions of reduced diameter being defined by shoulders, (b) each partition means is a rolling diaphragm carried on a respective diaphragm holder, each diaphragm holder having a central bore of diameter less than diameters of the adjacent rod portions, the diaphragm holders having central portions with the central bores which are fitted rotatably between the shoulder defining the portions of reduced diameter to reduce diaphragm strain, (c) seals cooperating with the rod and the diaphragm holders to seal the portions of reduced diameter and the central bores so as to prevent leakage therebetween.

9. An actuator as claimed in claim 1 in which the compression spring means is a compression coil spring enclosing the actuating rod.

10. An actuator as claimed in claim 3 in which the cylindrical housing and the limiting means are characterized by:

(a) an inner annular member having a bore diameter, (b) two intermediate annular members having respective bore diameters and being secured in spaced aligned relationship, one on either end of the inner annular member so as to sandwich the inner annular member therebetween, the bore of the inner annular member being greater than the bores of the intermediate annular members to define in part the annular recess of the limiting means.

11. An actuator as claimed in claim 10 in which the cylindrical housing is further characterized by:

(a) two outer cup members secured in spaced aligned relationship to outer edges of the two intermediate annular members respectively to sandwich the inner and two intermediate members therebetween, the cup members having end walls having aligned sealed bores to receive the actuating rod as a sliding fit therein, and the fluid ports to communicate with fluid conduits.

12. An actuator as claimed in claim 11 in which:

(a) the inner annular member and the two intermediate annular members define portions of the spring chamber, (b) the two outer cup members define portions of the two actuating chambers, (c) each partition means is a rolling diaphragm having an outer portion thereof secured to an adjacent interconnection between the intermediate annular member and an adjacent cup member, the interconnection being sealed to prevent leakage, the diaphragm also having an inner portion cooperating with the rod and an annular fold between the inner and outer portions thereof to permit relative axial movement between the rod and the housing with negligible diaphragm strain.

* * * * *